US010651533B2

(12) United States Patent
Hershey et al.

(10) Patent No.: US 10,651,533 B2
(45) Date of Patent: May 12, 2020

(54) SENSED SITUATION MILLIMETER-WAVE COMMUNICATIONS BEAM CONTROL

(71) Applicant: General Electric Company, Schenectady, NY (US)

(72) Inventors: John Erik Hershey, Ballston Lake, NY (US); Michael Joseph Dell'Anno, Clifton Park, NY (US)

(73) Assignee: GENERAL ELECTRIC COMPANY, Niskayuna, NY (US)

( * ) Notice: Subject to any disclaimer, the term of this patent is extended or adjusted under 35 U.S.C. 154(b) by 655 days.

(21) Appl. No.: 15/245,021

(22) Filed: Aug. 23, 2016

(65) Prior Publication Data

US 2018/0062246 A1 Mar. 1, 2018

(51) Int. Cl.

| | |
|---|---|
| ***H01Q 1/12*** | (2006.01) |
| ***H01Q 1/00*** | (2006.01) |
| ***H01Q 1/44*** | (2006.01) |
| ***H01Q 3/00*** | (2006.01) |
| ***H01Q 3/06*** | (2006.01) |
| ***H01Q 3/26*** | (2006.01) |

(52) U.S. Cl.

CPC ..... *H01Q 1/1242* (2013.01); *H01Q 1/005* (2013.01); *H01Q 1/44* (2013.01); *H01Q 3/005* (2013.01); *H01Q 3/06* (2013.01); *H01Q 3/26* (2013.01)

(58) Field of Classification Search

CPC ..... H01Q 1/125; H01Q 1/1242; G01S 19/26; G01S 3/14

See application file for complete search history.

(56) References Cited

U.S. PATENT DOCUMENTS

| | | | | |
|---|---|---|---|---|
| 3,453,633 | A | 7/1969 | Phillips | |
| 4,204,210 | A | 5/1980 | Hose | |
| 6,313,784 | B1 | 11/2001 | Pittman et al. | |
| 8,022,885 | B2 | 9/2011 | Smoyer et al. | |
| 8,766,872 | B2 * | 7/2014 | Dalmazzo | G01B 21/22 343/894 |
| 8,854,257 | B2 | 10/2014 | Hamner et al. | |
| 2009/0033576 | A1 * | 2/2009 | Smoyer | H01Q 1/125 343/761 |
| 2015/0230263 | A1 | 8/2015 | Roy et al. | |

(Continued)

FOREIGN PATENT DOCUMENTS

CN 103378892 A 10/2013

OTHER PUBLICATIONS

Oh, L; "Accurate boresight measurements of large antennas and radomes", IEEE Transactions on Antennas and Propagation, vol. 21, Issue: 4, pp. 567-569, Jul. 1973.

(Continued)

*Primary Examiner* — Robert Karacsony
(74) *Attorney, Agent, or Firm* — Fletcher Yoder, P.C.

(57) ABSTRACT

The present disclosure relates to a system includes an antenna disposed on a pole and a beam control unit disposed on the pole and operably coupled to the antenna. The beam control unit includes one or more sensors configured to detect one or more parameters related to tilting or bending of the pole. In addition, the beam control unit is configured to determine a misalignment of an antenna boresight as compared to an initial antenna boresight direction and to re-align the antenna boresight to the initial antenna boresight direction.

11 Claims, 4 Drawing Sheets

(56) References Cited

U.S. PATENT DOCUMENTS

2015/0346320 A1 12/2015 Hartman et al.
2019/0131703 A1* 5/2019 Meyer ..... H01Q 1/005

OTHER PUBLICATIONS

Daryoush, A.; et al., "Optical Beam Control of Millimeter Wave Phased Array Antennas for Communications", Microwave Conference, 1986. 16th European, pp. 864-869, Sep. 8-12, 1986, Dublin, Ireland.

* cited by examiner

SENSED SITUATION MILLIMETER-WAVE COMMUNICATIONS BEAM CONTROL

BACKGROUND

The subject matter disclosed herein relates to wireless communications, and more specifically to automatic re-alignment of antennas.

Antennas are used for a wide variety of communication applications. One of the more recent applications for antennas has been for wireless communications in the 57-64 gigahertz (GHz) industrial, scientific, and medical radio (ISM) band. This band is license-free under the ISM structure and offers 7 GHz of continuous spectrum. In addition, license-free 60 GHz millimeter wave communications may present operational advantages such as narrow beam width and oxygen absorption for interference immunity, privacy, and gigabit-plus data rates. However, at 60 GHz, a small antenna aperture or effective area can provide small beamwidth, which can entail operational problems if misalignment of an antenna occurs (e.g., offset or misalignment of antenna boresight). For example, a parabolic dish antenna with a diameter of only 10 centimeter (cm) and an efficiency of 0.65, exhibits a half-power beamwidth of about 3.4 degrees, and a change in this antenna's boresight of only 1.7 degrees would result in a drop of 3 decibels (dB) of power sent in the original direction. Such a situation is present in the use of 60 GHz communications where the antennas are mounted on structures that are subject to angular movement (e.g., antennas mounted atop utility poles or street lighting poles that sway, deflect, or vibrate when subjected to wind and/or other external forces). Traditionally, antenna alignment methods were developed based on beacons and/or a received signal strength indicator (RSSI). However, these techniques may be process-intensive and may not operate properly due to the need for a feedback link that is not present or other conditions. Accordingly, it is now recognized that it is desirable to provide systems and methods for antenna alignment independent of beacons or RSSI.

BRIEF DESCRIPTION

Certain embodiments commensurate in scope with the originally claimed subject matter are summarized below. These embodiments are not intended to limit the scope of the disclosure. Indeed, the present disclosure may encompass a variety of forms that may be similar to or different from the embodiments set forth below.

In one embodiment, a system includes an antenna disposed on a pole and a beam control unit disposed on the pole and operably coupled to the antenna. The beam control unit includes one or more sensors configured to detect one or more parameters related to tilting or bending of the pole. In addition, the beam control unit is configured to determine a misalignment of an antenna boresight as compared to an initial antenna boresight direction and to re-align the antenna boresight to the initial antenna boresight direction.

In another embodiment, a system includes a street lighting pole, an antenna disposed on the street lighting pole, and a beam control unit adjacent to the antenna. The beam control unit includes an alignment assembly operably coupled to the antenna and one or more sensors disposed in proximity of the antenna, wherein the one or more sensors are configured to collect one or more parameters related to misalignment of a boresight of the antenna caused by tilting or bending of the street lighting pole. The beam control unit also includes a memory and a processor configured to execute instructions stored on the memory including instructions for determining an initial boresight direction of the antenna, determining the misalignment of the boresight direction of the antenna based on the one or more parameters, and continuously re-aligning the misalignment of the boresight direction to the initial boresight direction of the antenna via the alignment assembly.

In another embodiment, a method for re-aligning an antenna including determining an initial boresight direction of the antenna disposed on a pole and determining misalignment of the antenna based on one or more parameters offset from the initial boresight direction, wherein the one or more parameters are collected via one or more sensors of a beam control unit disposed in proximity of the antenna. The method also includes re-aligning the antenna to the initial boresight direction via an alignment assembly of the beam control unit.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

As described below, an antenna beam control system may be developed to automatically re-align or re-center the antenna boresights independent of beacons or RSSI techniques. More specifically, the antenna beam control system may include one or more sensors (e.g., position sensor, accelerometer, etc.) to collect data related to the antenna orientation and/or alignment, thereby enabling a determination of re-alignment in the event of the antenna (e.g., antenna boresight) becoming misaligned due to weather conditions (e.g., wind blow, rain, etc.) and/or other external forces. The antenna beam control system may also include an actuation system (e.g., electrical or mechanical) to automatically re-align the antenna upon a determination of misalignment. The antenna may be a parabolic antenna (e.g., dish antenna), a phased-array antenna or spherical Lüneberg lens, and for instance, the actuation system may re-align the antenna mechanically or electrically depending on the type of antenna. Furthermore, the one or more sensors of the antenna beam control system may be calibrated as needed to ensure the accuracy of the misalignment determination.

Figure 1:
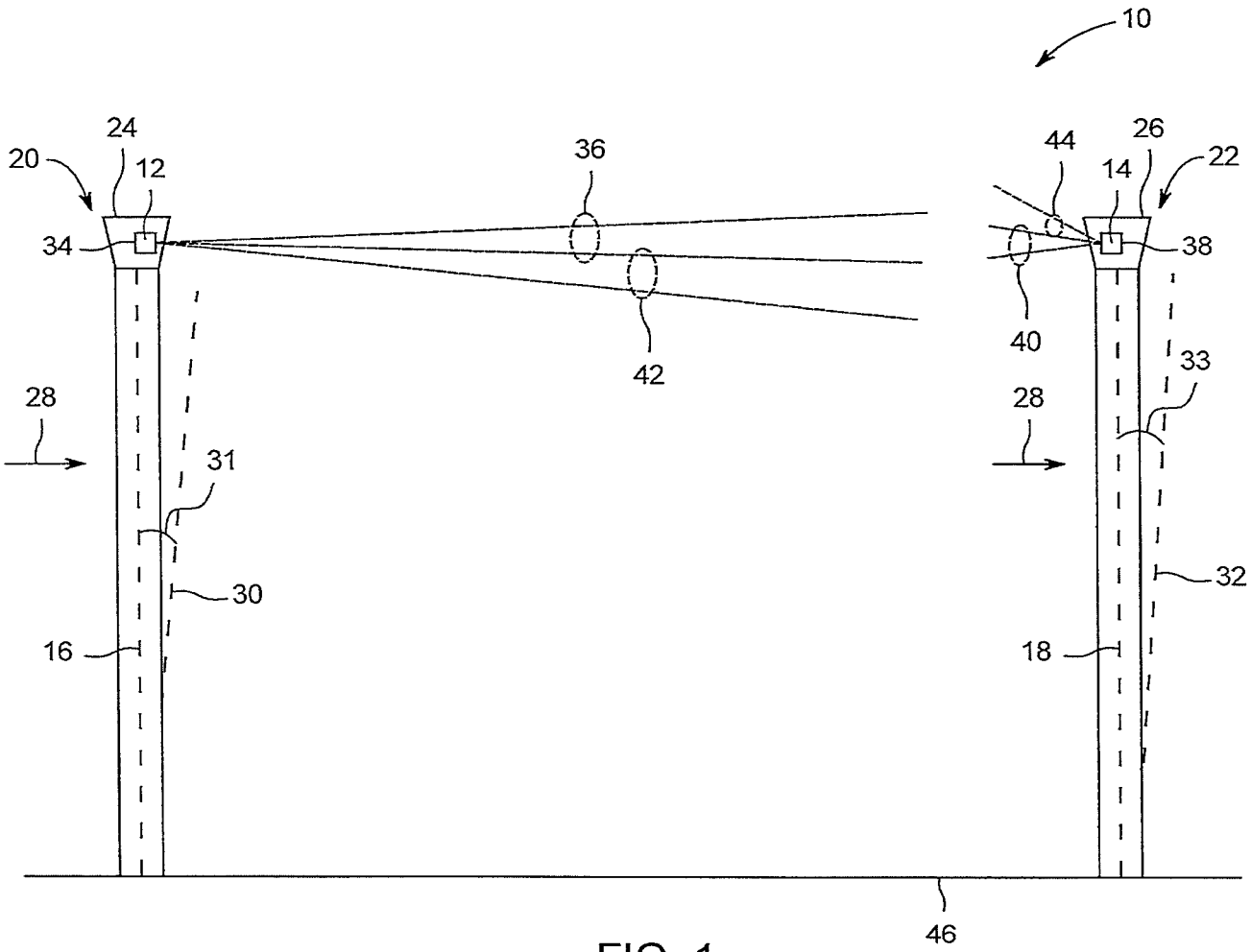
FIG. 1 is a schematic of an antenna communication system, illustrating misalignments of the antennas, in accordance with an aspect of the present disclosure.

FIG. 1 is a schematic of an embodiment of an antenna communication system 10. In the illustrated embodiment, the antenna communication system 10 includes antenna units 12 and 14 mounted atop poles 16 and 18. The poles 16 and 18 may be street lighting poles having top units 20 and 22. The top units 20 and 22 may host the antenna units 12 and 14. In some embodiments, the top units 20 and 22 may also host luminaires 24 and 26. It may be appreciated that as urban areas are becoming more equipped with high capacity, ubiquitous wireless communication facilities, a typical wireless communication system's components may use street lighting poles to host wireless relays. In other embodiments, the poles 16 and 18 may be any types of poles such as utility poles or towers. Each of the antenna units 12 and 14 may include one or more transmitting and receiving antennas to support a wireless communication relay. The antenna may be a parabolic antenna (e.g., dish antenna), a phased-array antenna, or spherical Lüneberg lens, for instance.

When the poles 16 and 18 are acted upon by a wind and/or other weather conditions or external forces, the poles 16 and 18 may sway, vibrate, or bend. For example, the pole 16 and 18 acted upon a wind blow in a direction 28 may bend or deflect to positions 30 and 32, forming deflection angles 31 and 33, respectively. The top unit 20 on the pole 16 may have a transmitting antenna 34 with a half-power beam width contour 36. Correspondingly, the top unit 22 on the pole 18 may have a receiving antenna 38 with a half-power beam width contour 40 and configured to receive transmission from the transmitting antenna 34. The deflection of the pole 16 may cause the boresight of the transmitting antenna 34 to be depressed so that the half-power beamwidth contour 36 is shifted down (e.g., toward the ground 46) to a shifted half-power beam width 42. As such, a misalignment occurs at the transmitting antenna 34. In addition, the deflection of the pole 18 may cause the boresight of the transmitting antenna 38 to be depressed so that the half-power beamwidth contour 40 is shifted up (e.g., away from the ground 46) to a shifted half-power beam width 44. As such, a misalignment occurs at the receiving antenna 38. Also note that since misalignments may occur at both the transmitting antenna 34 and the receiving antenna 38, the misalignment patterns may be doubly disturbed due to the movement down of one pattern (e.g., shifting in the half power beamwidth contour from 36 to 42) and the movement up by the other pattern (shifting in the half power beamwidth contour from 40 to 44).

While misalignments of antennas may be of minimal concern at many of the traditional operating frequencies as antenna patterns are generally broader, at the ISM frequency band of 57-64 GHz (e.g., 60 GHz), misalignments due to wind may significantly affect the link's operation (e.g., signal communication between the transmitting and receiving antenna) by insinuating occasional communication outages. It should also be noted that in some embodiments, misalignments due to wind may be significant (e.g., about eight degrees) when the pole 16 or 18 is a lighting pole. As an example, the California Department of Transportation sets the following requirement pertaining to such poles. The pole must comply with the latest edition and interim revisions of the American Association of State Highway and Transportation Officials (AASHTO) (e.g., "Standard Specifications for Structural Supports for Highway Signs, Luminaires and Traffic Signals"). The maximum allowable wind deflection must not exceed fourteen percent of the pole height. Consequently, a deflection of fourteen percent of the pole height would change the antenna's boresight by about eight degrees, which can significantly affect the link's operation as set forth above. In order to avoid these outages in operations at the ISM frequency of 57-64 GHz (e.g., 60 GHz), it may be beneficial to counter the effects of weather and/or external conditions (e.g., wind, rain, other external forces) shifting the narrow transmitting and receiving half-power beamwidths 36 and 40. Such systems and methods for automatic re-alignment of antennas are discussed below.

Figure 2:
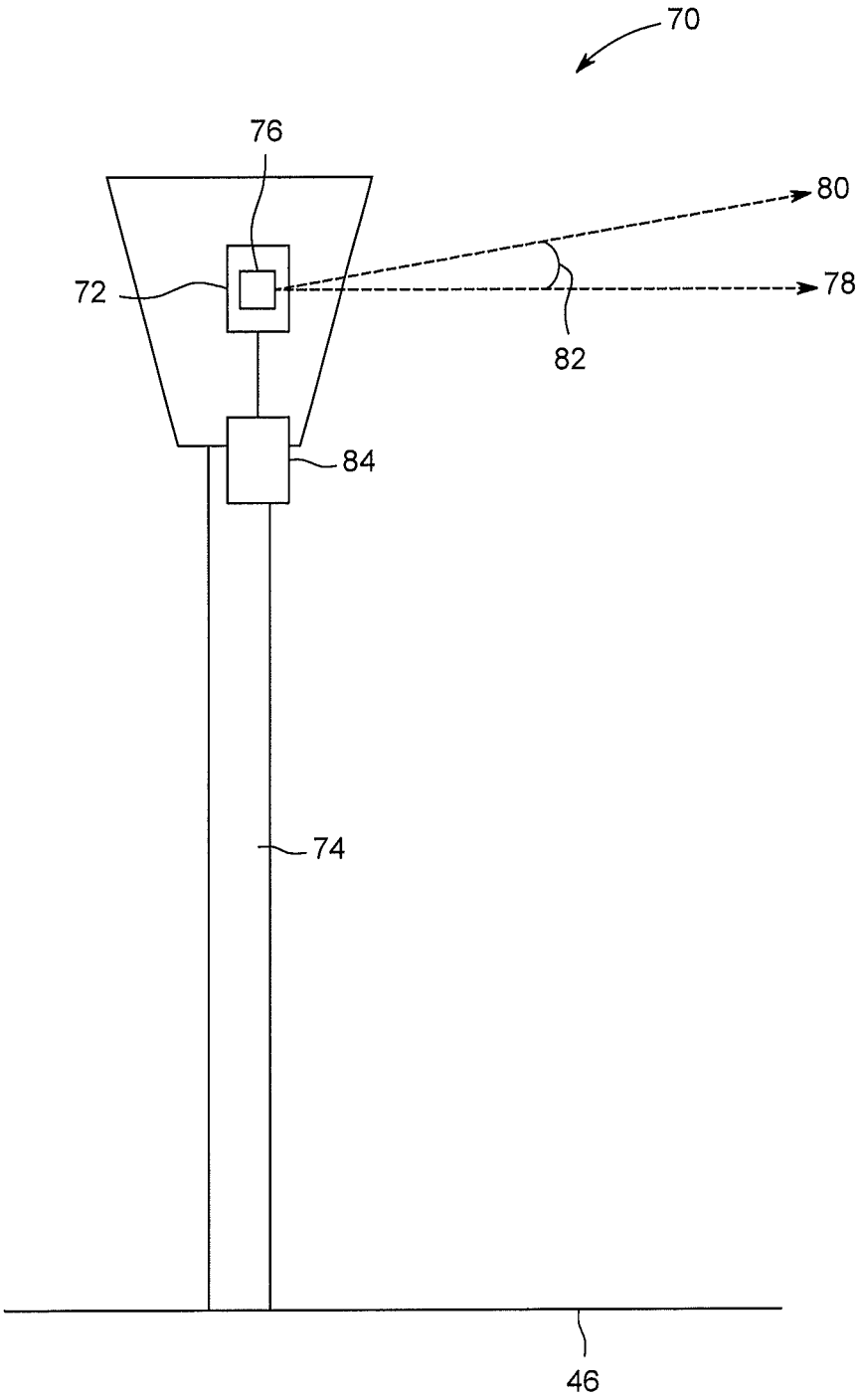
FIG. 2 is a schematic of an antenna beam control system including an antenna and a beam control unit, in accordance with an aspect of the present disclosure.

FIG. 2 is a schematic of an antenna beam control system 70 for re-alignment of an antenna. As set forth above, an antenna unit 72 may be mounted atop a pole (e.g., street lighting pole, utility pole, etc.) 74, and the antenna unit 72 may include one or more transmitting or receiving antennas 76. Herein, for simplicity, the one or more transmitting or receiving antennas 76 are referred as the antenna 76. The antenna 76 may transmit or receive wireless communication signals, with the boresight aligned in an initial boresight direction 78 (e.g., determined when the antenna 76 is well aligned). When the pole 74 and the antenna 76 connected thereto are acted upon a wind and/or any other external forces, the pole 74 may deflect, bend or vibrate, causing the boresight to shift to a misaligned boresight direction 80 such that a boresight offset angle is formed between the initial boresight direction 78 and the misaligned boresight direction 80. In order to counter the effects of deflection, bending or vibration of the pole 74, a beam control unit 84 is operatively coupled to the antenna unit 72 for automatically adjusting the boresight of the antenna 76 such that the boresight maintains at the initial boresight direction 78. The beam control unit 84 may be mounted atop the pole 74, adjacent to the antenna unit 72. In some embodiments, the antenna unit 72 and the beam control unit 84 may be powered via the same power supply of the pole 74 (e.g., street lighting pole, utility pole, etc.). In other embodiments, each of the antenna unit 72 and the beam control unit 84 may be powered by its own external or shared external power source (e.g., battery).

Figure 3:
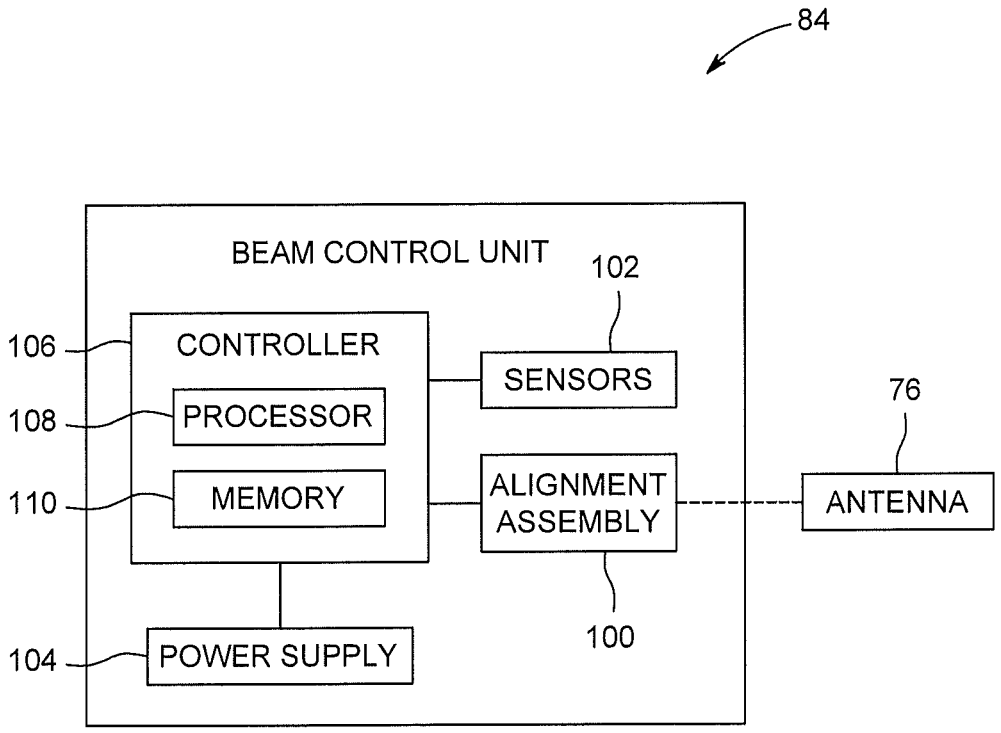
FIG. 3 is a block diagram of the beam control unit of FIG. 2, in accordance with an aspect of the present disclosure.

FIG. 3 is a block diagram of an embodiment of the beam control unit 84 for automatic boresight re-alignment. In the illustrated embodiment, the beam control unit 84 may include an alignment assembly (e.g., mechanical or electrical actuation system such as a gyroscope or a micro-electro-mechanical system, MEMS) 100, one or more sensors 102, a power supply 104, and a controller 106. The power supply 104 is configured to supply power to the beam control unit 84. The power supply 104 may also supply power to the antenna 76. In one embodiment, the power supply 104 may be one or more batteries. In another embodiment, the power supply 104 may be part of a power supply system of the pole 74 (e.g., electricity grid or power supply of a street lighting pole or utility pole) routed to supply power to the beam control unit 84 and/or the antenna 76.

The controller 106 may include a processor 108 and a memory 110 (e.g., non-transitory computer-readable medium/memory circuitry) communicatively coupled to the processor 108. In addition, the controller 106 may be communicatively coupled (e.g., receiving instructions via a radio frequency or wireless receiver) with a wireless network of a facility to receive information related to boresight re-alignment and/or calibration of the one or more sensors 102 (e.g., weather condition, wind speed, wind direction, etc.). The processor 108 may include one or more application specific integrated circuits (ASICs), one or more field programmable gate arrays (FPGAs), one or more general purpose processors, or any combination thereof. Furthermore, the term processor is not limited to just those integrated circuits referred to in the art as processors, but broadly refers to computers, processors, microcontrollers, microcomputers, programmable logic controllers, application specific integrated circuits, and other programmable circuits. The memory 110 may include volatile memory, such as random access memory (RAM), and/or non-volatile memory, such as read-only memory (ROM), optical drives, hard disc drives, or solid-state drives.

The memory 110 may store one or more sets of instructions (e.g., processor-executable instructions) implemented to perform operations related to antenna boresight re-alignment using the beam control unit 84. For example, the memory 110 may store a model of the antenna 76 (e.g., antenna type, configuration, orientation, initial boresight direction, etc.) such that the beam control unit 84 may re-store or re-align the antenna boresight to the initial boresight direction 78. For example, the memory 110 may store instructions to re-align the antenna boresight continuously or substantially continuously such that the boresight may remain at the initial boresight direction 78. For example, the memory 110 may store instructions to obtain information and collect data (e.g., using the one or more sensors 102), and store instructions to calibrate the one or more sensors 102 (e.g., to correct sensor drift). For example, the memory 110 may store relationships (e.g., pole-specific and antenna-specific relationships) between the pole deflection (e.g., the deflection angle 31 or 33) and the antenna boresight offset (e.g., the boresight offset angle 82). For example, the memory 110 may store algorithms that may update or modify the instructions to the alignment assembly 100 to re-align the antenna boresight based on the antenna type (e.g., a parabolic antenna, a phased-array antenna, spherical Lüneberg lens).

More specifically, the algorithms may determine that the antenna 76 is a parabolic antenna (e.g., dish antenna), and the re-alignment or re-centering of the antenna boresight may be actuated mechanically (e.g., executed by the alignment assembly 100) by mechanically servoing the antenna's 76 mounting so that the antenna's 76 pointing direction is deflected (e.g., by the boresight offset angle 82) so as to cancel the effects (e.g., tilt) imposed by the deflection of the pole 74. In some embodiments, the algorithms may determine that the antenna 76 is a phased-array antenna, and the re-alignment may be actuated electrically (e.g., executed by the alignment assembly 100) instead of mechanically. In some embodiments, the algorithms may determine that the antenna 76 is a spherical Lüneberg lens, and the re-alignment may be actuated by moving a movable excitation horn mounted on the surface of the Lüneberg lens (e.g., executed by the alignment assembly 100) so as to provide a beam in the direction of the corrected boresight (e.g., the initial boresight direction 78). It may be appreciated that such actuation mechanisms set forth above (e.g., for a parabolic antenna, a phase-array antenna, and spherical Lüneberg lens) are understood in the art.

The one or more sensors 102 may be disposed in proximity of the antenna 76 atop the pole 74 (with reference to FIG. 2), and the one or more sensors 102 may include accelerometers, tilt sensors, vibration sensors, angle measurement sensors, ultrasound wind sensor, or a combination thereof. The one or more sensors 102 are coupled to the processor 108 to obtain one or more parameters related to antenna alignment, boresight alignment, and/or pole deflection, and the one or more parameters are fed to the controller 106. For example, the one or more parameters may include, but are not limited to antenna position and one or more angles such as pole deflection angle, antenna azimuth angle, and antenna elevation angle, or a combination thereof. The one or more parameters collected via the one or more sensors 102 may be stored in the memory 110. It may be appreciated that the one or more sensors 102 may be configured to perform continuous sensing as to enable continuous re-alignment or adjustment of the antenna boresight. It may also be appreciated that the output of the one or more sensors 102 are processed using techniques well known in the art to provide the one or more parameters (e.g., angles and distance) by which the pole 74 has been deflected and/or the boresight has shifted.

In addition, as set forth above, the one or more sensors 102 may be calibrated (e.g., correction of the tilt information due to sensor drift) periodically or as needed. For example, when an accelerometer is used as a tilt information sensor, it is often affected by drift, contributing to an initially small but growing offset from a true value. This offset may adversely affect the re-centering of the boresight if the accelerometer is not corrected for a prolonged period. In one embodiment, the one or more sensors 102 may be calibrated in a predetermined periodicity (e.g., minutes, hours, days, or weeks). In one embodiment, the one or more sensors 102 may be calibrated upon receiving a reset signal through the wireless network from a facility that monitors wind activity and sends the reset signal when wind conditions have been sufficiently quiet. In one embodiment, the calibration of the one or more sensors 102 may be performed upon a determination that the wind speed is below a predetermined threshold for a predetermined period of time. For example, if the ultrasound wind sensor (e.g., disposed atop of the pole 74) measures a wind speed below a predetermined threshold for a predetermined period of time, a reset signal may be sent (e.g., by the controller 106) to the one or more sensors 102 for sensor calibration. In another embodiment, upon a determination by the ultrasound wind sensor that the wind speed is below a predetermined threshold for a predetermined period of time, reset signals may be sent (e.g., by the controller 106) to one or more sensors disposed on poles in proximity to the pole 74 (e.g., these poles are not equipped with an ultrasound wind sensor).

Figure 4:
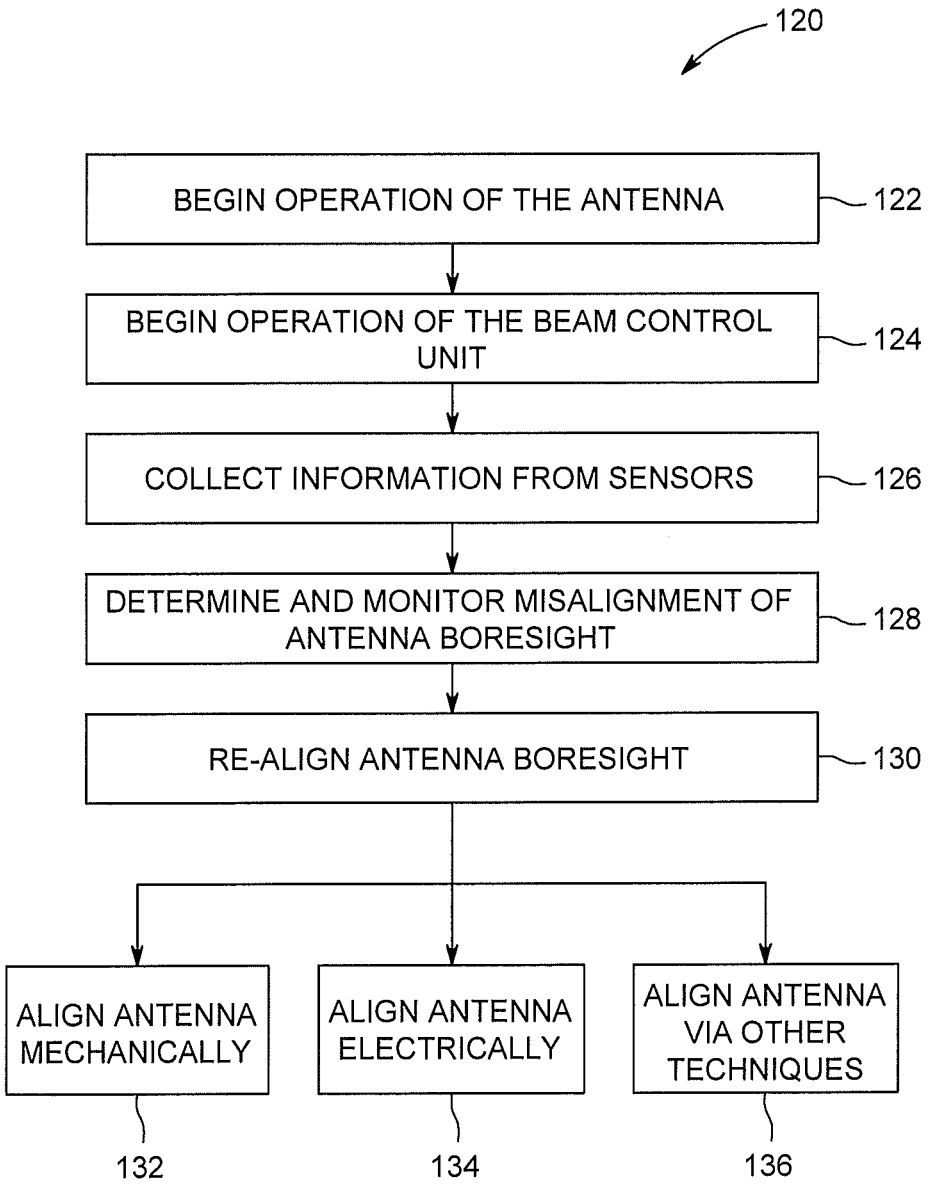
FIG. 4 is flow chart of a process for re-aligning antennas, in accordance with an aspect of the present disclosure.

FIG. 4 is a flow chart illustrating a method 120 for utilizing the beam control unit 84. One or more of the steps of the method 120 may be executed by the controller 106 of the beam control unit 84. The method 120 includes beginning operation of the antenna 76 (step 122), beginning the operation of the beam control unit 84 (step 124), collecting information from sensors (step 126), determining and monitoring misalignment of antenna boresight (step 128), and re-aligning antenna boresight (step 130). In particular, upon beginning operation of the antenna 76, the antenna boresight is well aligned (e.g., in an initial boresight direction 78), and upon beginning operation of the beam control unit 84, the one or more sensors 102 operate to continuously collect information (e.g., one or more parameters) related to antenna alignment, boresight alignment, and/or pole deflection, and the collected information is fed to the controller 106. The beam control unit 84 may continuously determine and monitor (e.g., via the one or more sensors 102) if an antenna boresight misalignment has occurred. For example, the beam control unit 84 may be continuously monitoring the boresight offset angle (e.g., angle between the initial boresight direction 78 and the misaligned boresight direction 80) to determine the boresight misalignment. In addition, as set forth above, the one or more sensors 102 may be calibrated periodically or when determined as suitable upon receiving a reset signal to ensure the accuracy of the data/information collection.

The method 120 also includes aligning the antenna 76 mechanically (step 132), aligning the antenna 76 electrically (step 134), or aligning the antenna 76 via other techniques (step 136). In particular, based on the determined offset angle, the controller 106 may re-align the antenna boresight (step 130) using the alignment assembly 100 coupled to the antenna 76. In some embodiments, the antenna 76 is a parabolic antenna (e.g., dish antenna), and the re-alignment or re-centering of the antenna boresight may be actuated mechanically (step 132) by mechanically servoing the antenna's 76 mounting so that the antenna's 76 pointing direction is deflected (e.g., by the boresight offset angle 82). In some embodiments, the antenna 76 is a phased-array antenna, and the re-alignment may be actuated electrically (step 134) instead of mechanically. For example, the alignment assembly 100 may adjusting phases of the phased-array antenna's excitation array. In some embodiments, the antenna 76 is a spherical Lüneberg lens, and the re-alignment may be actuated by other techniques (step 136). For example, the alignment assembly 100 may move a movable excitation horn mounted on the surface of the Lüneberg lens so as to provide a beam in the direction of the corrected boresight (e.g., the initial boresight direction 78).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system comprising:

an antenna disposed on a pole; and a beam control unit disposed on the pole and operably coupled to the antenna, wherein the beam control unit comprises one or more sensors configured to detect one or more parameters related to tilting or bending of the pole; wherein the beam control unit is configured to:

determine a misalignment of an antenna boresight as compared to an initial antenna boresight direction and to re-align the antenna boresight to the initial antenna boresight direction; and perform calibration of the one or more sensors upon a determination that a weather condition parameter is below a predetermined threshold for a predetermined period of time.

2. The system of claim 1, wherein the antenna is configured to transmit or receive signals for sixty gigahertz (GHz) millimeter wave communication.

3. The system of claim 1, wherein the antenna is a parabolic antenna, a phased-array antenna, or spherical Lüneberg lens.

4. The system of claim 1, wherein the antenna boresight is re-aligned by electrically adjusting phases of an excitation array of the antenna, by servoing mounting of the antenna, or by moving an excitation horn of the antenna.

5. The system of claim 1, wherein the one or more sensors comprise accelerometers, tilt sensors, vibration sensors, angle measurement sensors, ultrasound wind sensors, or a combination thereof.

6. The system of claim 1, wherein the one or more parameters comprise antenna position, pole deflection angle, antenna azimuth angle, antenna elevation angle, or a combination thereof.

7. The system of claim 1, wherein the weather condition parameter comprises a wind speed.

8. The system of claim 7, wherein the beam control unit is communicatively coupled to a wireless network to receive the determination that the wind speed is below the predetermined threshold for the predetermined period of time.

9. The system of claim 7, wherein the determination that the wind speed is below the predetermined threshold for the predetermined period of time is based on data collected using an ultrasound wind sensor disposed on the pole.

10. The system of claim 1, wherein the beam control unit is configured to continuously re-align the antenna boresight to the initial antenna boresight alignment via an alignment assembly.

11. The system of claim 1, comprising a battery to power the beam control unit.

* * * * *